US005645895A

United States Patent [19]

Murayama et al.

[11] Patent Number: 5,645,895

[45] Date of Patent: Jul. 8, 1997

[54] METHOD FOR PAINTING A VEHICLE BODY

[75] Inventors: Junichi Murayama; Niichi Toyama; Kazuhide Matsuo; Hideki Takashima; Katsushi Sadamitsu; Kiichi Sugino; Kazuto Iiyama, all of Sayama, Japan

[73] Assignee: Honda Giken Kogyo Kabushiki Kaisha, Tokyo, Japan

[21] Appl. No.: 831,644

[22] Filed: Feb. 7, 1992

Related U.S. Application Data

[63] Continuation of Ser. No. 745,769, Aug. 12, 1991, abandoned, which is a continuation of Ser. No. 293,432, Jan. 4, 1989, abandoned.

[30] Foreign Application Priority Data

Sep. 5, 1988 [JP] Japan ..... 63-221532

[51] Int. Cl.[6] ..... B05D 1/02

[52] U.S. Cl. ..... 427/424; 118/315; 118/323

[58] Field of Search ..... 427/424, 421, 427/425; 118/315, 323, 305, 314, 324

[56] References Cited

U.S. PATENT DOCUMENTS

| | | | |
|---|---|---|---|
| 2,900,950 | 8/1959 | Peeps . | |
| 3,533,422 | 10/1970 | Alimanestiano . | |
| 3,619,311 | 11/1971 | Rose et al. | 118/323 |
| 3,709,190 | 1/1973 | Van Gottberg et al. | 118/323 |
| 3,742,906 | 7/1973 | Dupke . | |
| 4,278,046 | 7/1981 | Clarke et al. . | |
| 4,590,654 | 5/1986 | Kajiura . | |
| 4,721,630 | 1/1988 | Takeo et al. | 427/421 |
| 4,729,908 | 3/1988 | Mahrle | 427/421 |
| 4,869,201 | 9/1989 | Takahashi et al. | 427/421 |
| 4,931,322 | 6/1990 | Yamamoto et al. | 427/421 |

FOREIGN PATENT DOCUMENTS

| | | |
|---|---|---|
| 0084523 | 7/1983 | European Pat. Off. . |
| 60-25565 | 2/1985 | Japan . |
| 806765 | 12/1958 | United Kingdom . |
| 1322861 | 7/1973 | United Kingdom . |
| 2190312 | 11/1987 | United Kingdom . |
| 2200304 | 8/1988 | United Kingdom . |

*Primary Examiner*—Benjamin Utech

*Attorney, Agent, or Firm*—Birch, Stewart, Kolasch & Birch, LLP

[57] ABSTRACT

An outer surface of an object such as an automotive vehicle body is painted by conveying the object in one direction, moving a painting apparatus in a direction opposite to the one direction, and applying a paint coating to the outer surface of the object from the painting apparatus. The painting apparatus includes a plurality of paint spray guns which are displaceable in a direction transverse to the direction in which the object is conveyed. The paint spray guns are directed substantially perpendicularly to and spaced a predetermined distance from the surface of the object.

5 Claims, 9 Drawing Sheets

66
88a
52
64
88b
68
142
166a
166b
166c
166d
224a(b)
220
224c(d)
C
230
234a
238a
234b
W
236
238b
232
70
88c

METHOD FOR PAINTING A VEHICLE BODY

This application is a continuation of application Ser. No. 07/745,969 filed on Aug. 12, 1991, now abandoned, which is a continuation of application Ser. No. 07/293,432 filed on Jan. 4, 1989, now abandoned.

BACKGROUND OF THE INVENTION

The present invention relates to a method of and an apparatus for painting or coating an object, and more particularly to a method of and an apparatus for applying a high-quality paint coating to an outer surface of an automotive vehicle body which is being conveyed along a paint coating line.

Automobile industry in recent years employs highly automated line production processes for efficiently mass-producing automobile products. There are used assembling apparatus for assembling individual parts and conveyor apparatus for conveying components to respective working positions. Painting apparatus for painting or coating automobile bodies are also automated.

Various methods have heretofore been employed for automatically painting automobile bodies. According to one known painting method, for example, an automobile vehicle body which has already been coated on its inner surface is conveyed by a conveyor apparatus, and sprays of paint are applied from a plurality of paint spray guns to side panels, an engine hood, a roof, and a trunk lid of the vehicle body as it is conveyed, so that the vehicle body will be coated.

In the above painting method, however, since the vehicle body is coated while it is being conveyed with respect to the fixed painting apparatus, the distance that the vehicle body is conveyed is considerably long. Therefore, the paint coating line takes up a large space, failing to achieve effective utilization of a working space.

Another painting method which has been used keeps an automobile vehicle body at rest in a painting position and displaces a painting apparatus with a plurality of paint spray guns with respect to the vehicle body for coating the same (see Japanese Laid-Open Patent Publication No. 60-25565, for example). The paint spray guns are arranged in an inverted U-shaped, or portal-shaped, pattern so that they confront the side panels and upper panel of the vehicle body. More specifically, the portal-shaped painting apparatus includes two side painting mechanisms located on opposite sides and each having a plurality of paint spray guns, and an upper painting mechanism located on the upper side and having a plurality of spray guns directed downwardly.

The portal-shaped painting apparatus is moved with respect to the stationary vehicle body, during which time paint sprays are applied from the paint spray guns on the upper and side painting mechanisms to the vehicle body.

With this method, however, the painting mechanisms have to travel for a distance corresponding to the length of the vehicle body. This has proven unsatisfactory in view of demands for higher operation efficiency and more effective utilization of working space on the assembly line.

An automotive vehicle body comprises various components such as a relatively horizontal roof, front and rear pillars which are inclined relatively largely, an engine roof, a trunk lid, and other parts. Since these components are different in shape, it is difficult to apply a uniform paint coating to the entire vehicle body. Particularly, a front portion of the engine roof and a rear portion of the trunk lid tend to remain uncoated. It has been necessary to apply a paint coat to those uncoated areas after the vehicle was coated by the painting apparatus. Accordingly, the efficiency of the painting method has been poor.

During the painting process, the paint spray guns are moved at a constant speed in the longitudinal direction of the vehicle body. The surfaces to be coated of the horizontal roof and the front and rear pillars which are largely inclined with respect to the vertical direction are coated at different speeds. Specifically, the speed at which the front and rear pillars are coated is higher than the speed at which the roof is coated. Consequently, when the front and rear pillars are coated, a sufficient paint coating is not applied to their surfaces, with the result that the thickness of the paint coat on the entire vehicle body is liable to be irregular.

SUMMARY OF THE INVENTION

It is a general object of the present invention to provide a method of and an apparatus for painting an object such as an automotive vehicle body while it is being conveyed along an automatic paint coating line which is shortened for effective utilization of space, and for applying a high-quality paint coating to the entire surface to be coated of such an object uniformly and efficiently.

Another object of the present invention is to provide a method of painting an outer surface of an object, comprising the steps of: conveying said object in one direction; moving a painting apparatus in a direction opposite to said one direction; and applying a paint coating to the outer surface of the object from said painting apparatus.

Still another object of the present invention is to provide a method of painting the outer surface of the object, wherein said object comprises an automotive vehicle body, said method further comprising the step of: applying a paint coating to an upper portion of said automotive vehicle body while said automotive vehicle body is being conveyed in said one direction and said painting apparatus is being moved in the direction opposite to said one direction.

Still another object of the present invention is to provide a method of painting the outer surface of the object, wherein said object comprises an automotive vehicle body, said method further comprising the step of: applying a paint coating to a side portion of said automotive vehicle body while said automotive vehicle body is being conveyed in said one direction and said painting apparatus is being moved in the direction opposite to said one direction.

Yet another object of the present invention is to provide a method of painting the outer surface of the object, wherein said painting apparatus includes paint spraying means for applying the paint coating to said outer surface of the object, said method further comprising the step of: displacing said paint spraying means in a direction transverse to said one direction.

Yet still another object of the present invention is to provide a method of painting the outer surface of the object, wherein said object comprises an automotive vehicle body.

A still further object of the present invention is to provide a method of painting the outer surface of the object, wherein said automotive vehicle body has at least front and rear ends extending substantially vertically, said painting apparatus including at least one paint spray gun, said method further comprising the steps of: displacing said paint spray gun vertically to apply a paint coating to said front or rear end; and simultaneously holding said automotive vehicle body at rest.

A yet further object of the present invention is to provide a method of painting the outer surface of the object, wherein said painting apparatus includes a plurality of paint spray guns spaced from each other so that paint sprays ejected respectively from said paint spray guns will not interfere with each other, said method further comprising the steps of: displacing said paint spray guns and said object relatively to each other and applying paint sprays from said paint spray guns to said object to form a plurality of strips of paint thereon; thereafter displacing said paint spray guns; and applying paint sprays from said paint spray guns to said object to form paint coatings in uncoated areas between said strips of paint.

A yet still further object of the present invention is to provide a method of painting an object which is being conveyed at a predetermined speed by a conveyor mechanism, said method comprising the steps of: directing paint spraying means substantially perpendicularly to a surface to be coated of said object which is being conveyed; spacing said paint spraying means a predetermined distance from said surface of the object; and ejecting paint sprays from said paint spraying means to form a paint coating on said surface of the object.

Still another object of the present invention is to provide a method of painting an object which is being conveyed at a predetermined speed by a conveyor mechanism, said method comprising the steps of: directing first paint spraying means substantially perpendicularly to a side surface to be coated of said object which is being conveyed; spacing said first paint spraying means a predetermined distance from said side surface of the object; ejecting paint sprays from said first paint spraying means to form a paint coating on said side surface of the object; directing second paint spraying means substantially perpendicularly to front, upper, and rear surfaces to be coated of said object; angularly moving and/or vertically moving said second paint spraying means; moving said second paint spraying means in the same direction as the direction in which said object is conveyed; spacing said second paint spraying means a predetermined distance from said front, upper, and rear surfaces of the object; and ejecting paint sprays from said second paint spraying means to form paint coatings on said front, upper, and rear surfaces of the object.

It is also an object of the present invention to provide an apparatus for painting an object, comprising: a conveyor mechanism for conveying the object at a predetermined speed; a side painting mechanism for coating a side surface of the object which is being conveyed by said conveyor mechanism; and an upper painting mechanism for coating front, upper, and rear surfaces of the object which is being conveyed by said conveyor mechanism, said upper painting mechanism being movable back and forth along the direction in which said object is conveyed, said upper painting mechanism including angularly and vertically movable paint spraying means and means for directing said movable paint spraying means substantially perpendicularly to said front, upper, and rear surfaces of the object and spacing said movable paint spraying means a predetermined distance from said front, upper, and rear surfaces of the object while coating them.

Another object of the present invention is to provide an apparatus for painting an object, wherein said paint spraying means comprises a plurality of paint spray guns, said upper painting mechanism also including swinging means for swinging said paint spray guns in unison in a direction transverse to the direction in which said object is conveyed.

Still another object of the present invention is to provide an apparatus for painting an object, wherein said swinging means comprises a rotative drive source, a disc coupled to and rotatable by said rotative drive source, a link operatively connected to said disc through an eccentric pin displaced from the center of rotation of the disc, and a rod coupled to said link and connected to said paint spray guns, whereby said paint spray guns can be swung in unison by operating said rotative drive source to rotate said disc to cause said link to displace said rod back and forth.

Still another object of an present invention is to provide an apparatus for painting the object, wherein said upper painting mechanism further includes a swing arm, said paint spray guns being mounted on said swing arm, said swing arm being shiftable in a direction transverse to the direction in which said object is conveyed.

Yet another object of the present invention is to provide an apparatus for painting an object, wherein said side painting mechanism includes paint spraying means which is at least vertically movable.

Yet still another object of the present invention is to provide an apparatus for painting an object, wherein said paint spraying means of said side painting mechanism comprises a plurality of paint spray guns spaced from each other and swingable independently of each other.

A further object of the present invention is to provide a method of painting an object which is being conveyed at a predetermined speed by a conveyor mechanism, said method comprising the steps of: directing paint spraying means substantially perpendicularly to surfaces to be coated of said object which is being conveyed; spacing said paint spraying means a predetermined distance from said surfaces of the object; controlling the speed of movement of said paint spraying means with respect to said surfaces of the object such that said surfaces will be coated at a constant coating speed by said paint spraying means; ejecting paint sprays from said paint spraying means to form paint coatings on said surfaces of the object.

A still further object of the present invention is to provide a method of painting an object, wherein said object comprises an automotive vehicle body having as said surfaces to be coated a front end, an engine hood, front pillars, a roof, rear pillars, a trunk lid, and a rear end, said method further comprising the step of: vertically moving and/or rotating said paint spraying means with respect to said automotive vehicle body dependent on angles of inclinations of said surfaces to be coated with respect to a horizontal plane, such that said surfaces will be coated at the constant coating speed by said paint spraying means.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
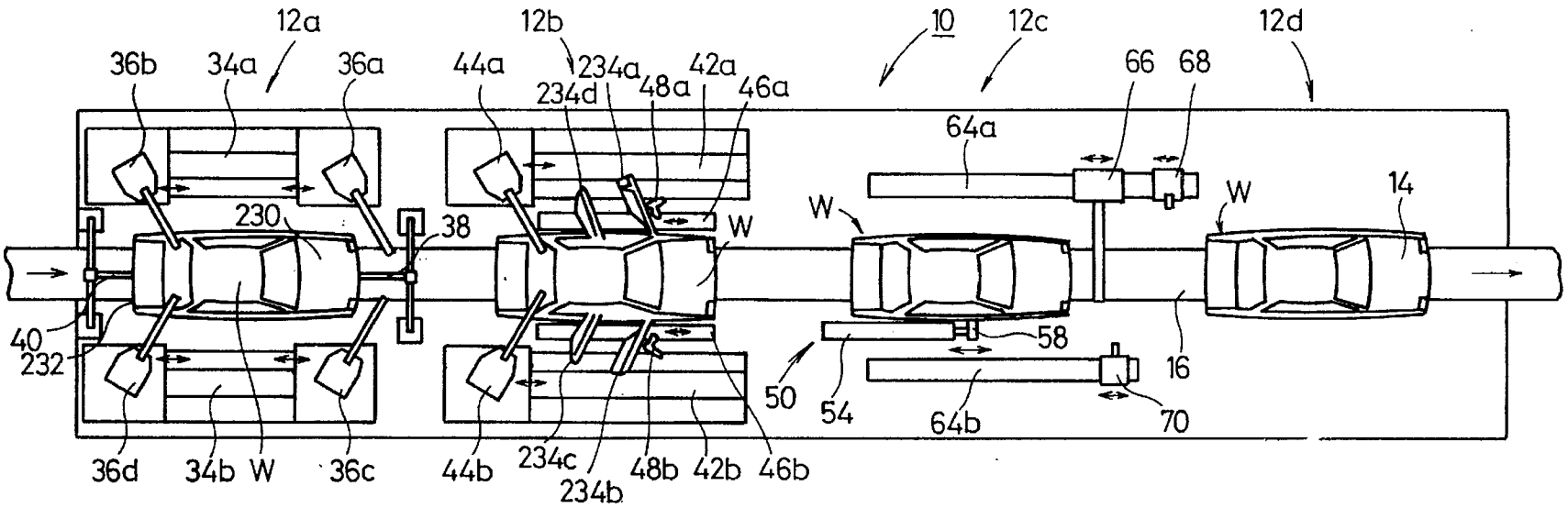
FIG. 1 is a plan view of a paint coating line employing a painting method according to the present invention.

FIG. 1 shows a paint coating line 10 for automobiles which employs a painting method according to the present invention. The paint coating line 10 is divided into a first painting stage 12*a*, a second painting stage 12*b*, a third painting stage 12*c*, and a fourth painting stage 12*d* for coating different areas or surfaces of an automotive vehicle body. The paint coating line 10 includes a vehicle body conveyor mechanism 16 extending through the first through fourth painting stages 12*a*–12*d* for conveying an automotive vehicle body W.

Figure 2:
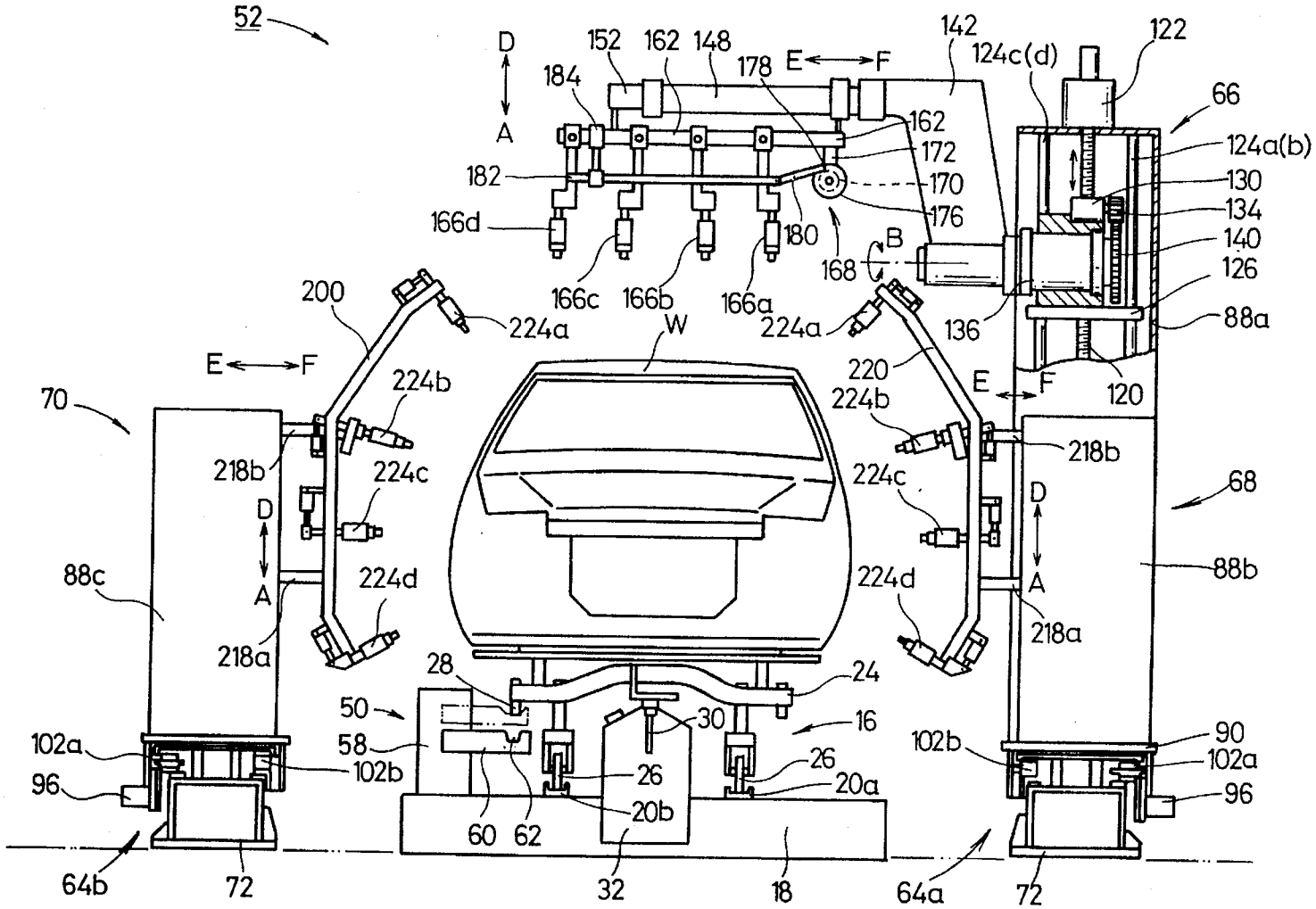
FIG. 2 is a front elevational view of a painting apparatus employed for carrying out the painting method of the invention.

The conveyor mechanism 16 is shown in detail in FIG. 2. The conveyor mechanism 16 includes a base 18 disposed below the vehicle body W and located substantially in the center of the paint coating line 10. Guide rails 20*a*, 20*b* are mounted on an upper surface of the base 18. A carriage 24 is movable on and along the guide rails 20*a*, 20*b* for carrying the vehicle body W which is an object to be coated on the paint coating line 10. The carriage 24 includes a plurality of wheels 26 positioned in rolling engagement with the guide rails 20*a*, 20*b*, and a finger 28 for engaging a conveyor means (described later) in the third painting stage 12*c*. An engaging member 30 extending downwardly is attached substantially centrally to the carriage 24 for engagement with a chain conveyor 32 extending substantially centrally through the base 18. With the vehicle body W placed on the carriage 24 and the engaging member 30 engaging the chain conveyor 32, the chain conveyor 32 is operated to convey the vehicle body W along the guide rails 20*a*, 20*b* through the first painting stage 12*a* through the fourth painting stage 12*d*. The first through fourth painting stages 12*a*–12*d* will be described below.

In the first painting stage 12*a*, the inner panels of the engine compartment and trunk compartment of each vehicle body W are painted. The first painting stage 12*a* includes two rails 34*a*, 34*b* one on each side thereof, and coating robots 36*a* through 36*d* movably disposed on the rails 34*a*, 34*b*. The first painting stage 12*a* also includes an engine hood opening/closing mechanism 38 and a trunk lid opening/closing mechanism 40.

In the second painting stage 12*b*, the inner surfaces of the doors of each vehicle body W are painted. The second painting stage 12*b* includes two rails 42*a*, 42*b* one on each side thereof and coating robots 44*a*, 44*b* movably disposed on the rails 42*a*, 42*b* for applying paint coatings to the inner surfaces of the doors. Additional rails 46*a*, 46*b* are disposed between the vehicle body conveyor mechanism 16 and the rails 42*a*, 42*b*, and door opening/closing mechanisms 48*a*, 48*b* are movably mounted on the rails 46*a*, 46*b*, respectively.

In the third painting stage 12*c*, the outer panels including the engine hood, trunk lid, roof, and doors of each vehicle body W are painted. In the first through third painting stages 12*a* through 12*c*, the electrostatic paint coating process is employed in which the paint is electrostatically applied to the vehicle body W.

Figure 3:
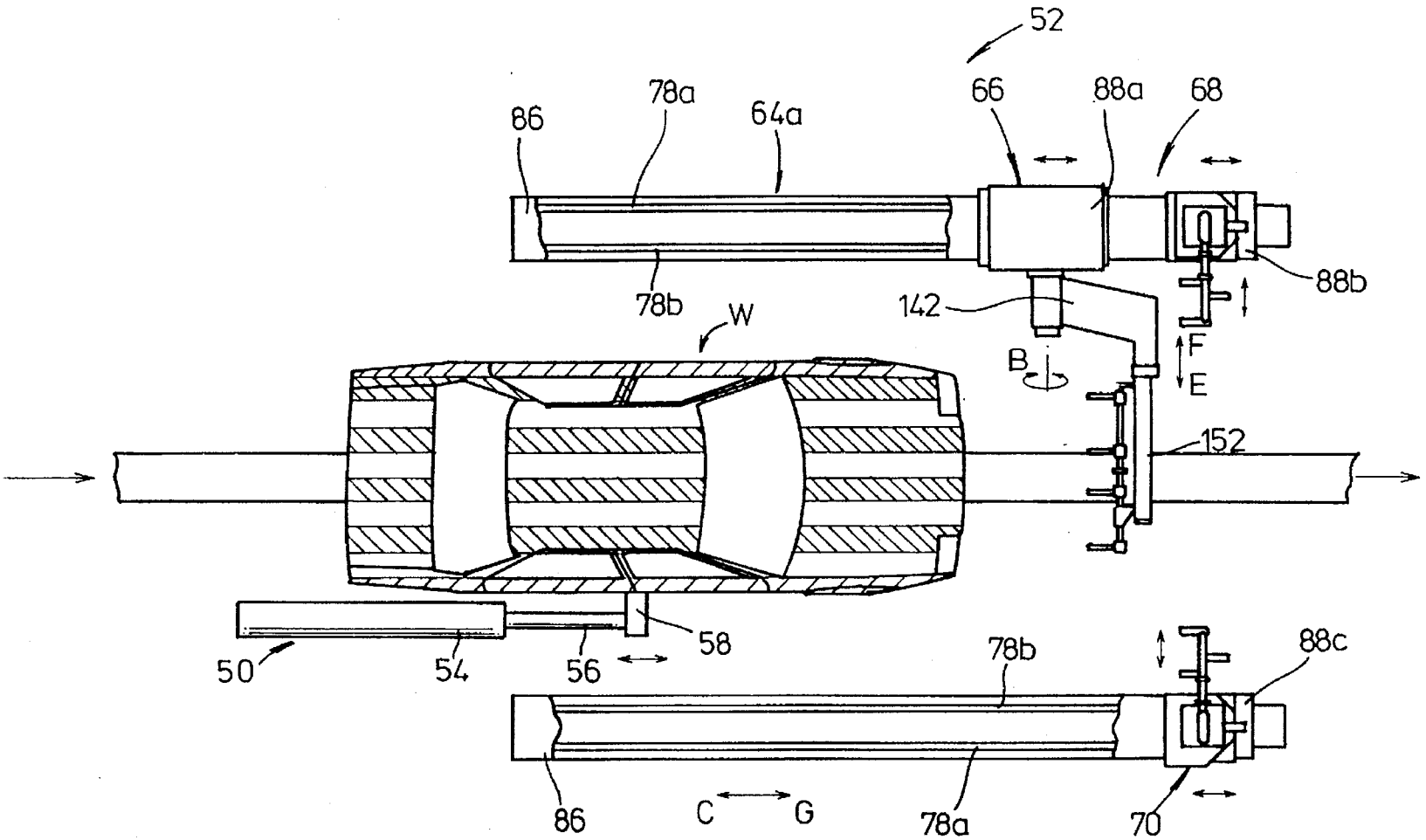
FIG. 3 is a plan view of the painting apparatus shown in FIG. 2.

As shown in FIGS. 2 and 3, the third painting stage 12*c* includes a vehicle body conveyor means 50 and a painting apparatus 52. The vehicle body conveyor means 50 includes a large-stroke cylinder 54 disposed parallel to the direction in which the vehicle body W is moved. The cylinder 54 has a piston rod 56 with a casing 58 attached to the distal end thereof. An engaging member 60 is supported on the casing 58 and displaceable vertically (FIG. 2) by a drive source (not shown) disposed in the casing 58. The engaging member 60 has a recess 62 defined in one end thereof for engaging the finger 28 on the carriage 24. The vehicle body W can be moved forwardly or rearwardly along the paint coating line by holding the finger 28 in engagement with the recess 62 and operating the cylinder 54.

The painting apparatus 52 is movable relatively to the vehicle body W which is movable by the conveyor means 50. The painting apparatus 52 is basically composed of an upper painting mechanism 66 and a lefthand side painting mechanism 68 which are movable along a rail 64*a* disposed on one side of the third painting stage 12*c*, and a righthand side painting mechanism 70 which is movable along a rail 64*b* disposed on the other side of the third painting stage 12*c*.

Figure 4:
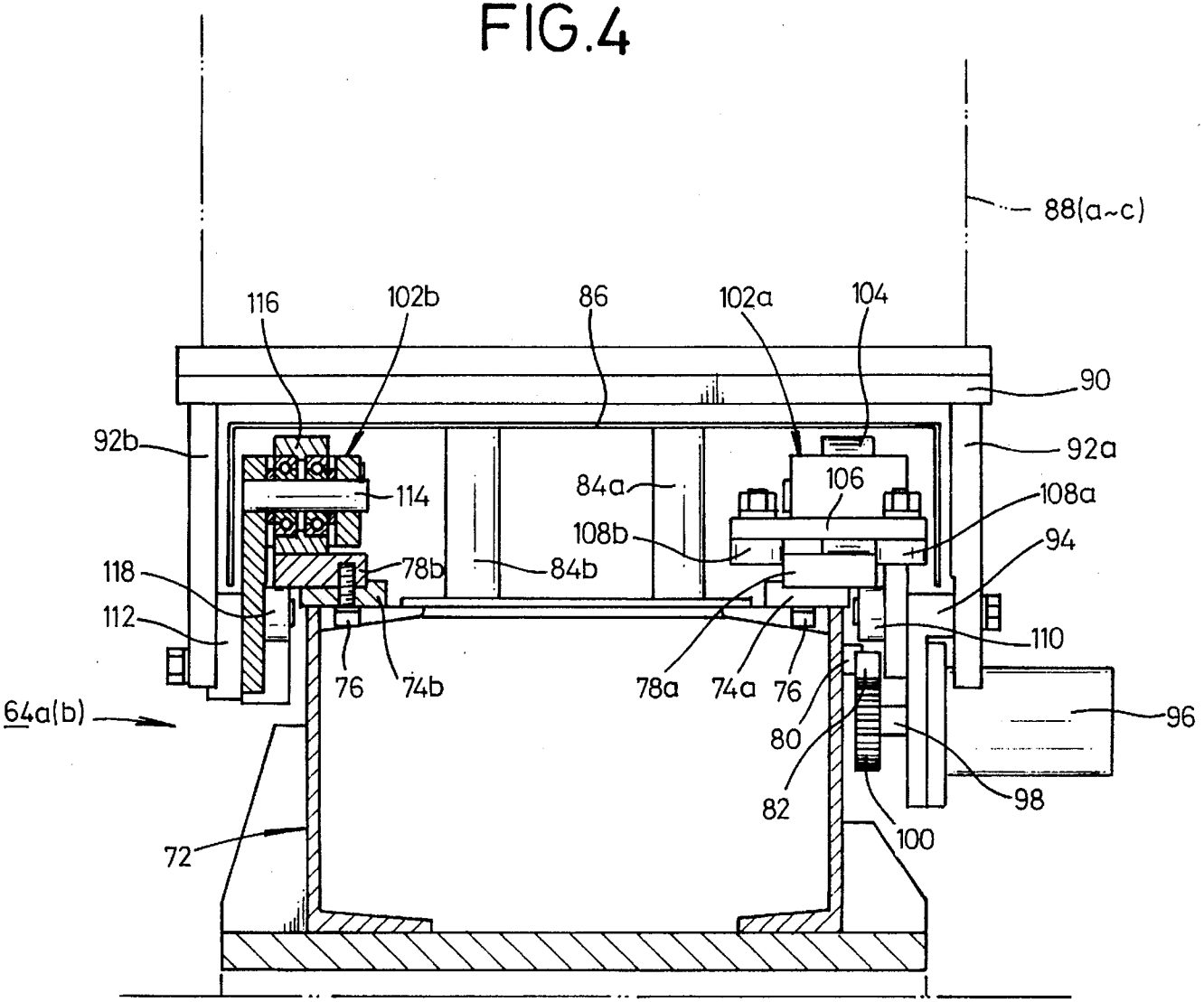
FIG. 4 is a cross-sectional view of a transport means of the painting apparatus shown in FIG. 2.

In the third painting stage 12*c*, the upper painting mechanism 66, the lefthand side painting mechanism 68, and the righthand side painting mechanism 70 are moved along the rails 64*a*, 64*b* by transport means which are of essentially the same design. More specifically, as shown in FIG. 4, each of the rails 64*a*, 64*b* comprises a rail bracket 72. To the upper surface of the rail bracket 72, there are fixed spacers 74*a*, 74*b* on its opposite sides with rails 78*a*, 78*b* secured to their upper surfaces by means of bolts 76. A rack 82 is attached to a vertical outer side of the rail bracket 72 by a support member 80. Two vertical posts 84*a*, 84*b* are mounted on the upper surface of the rail bracket 72, and a protective cover 86 having an inverted channel-shaped cross section is fixed to the upper ends of the posts 84*a*, 84*b*. The protective cover 86 extends along the rails 78*a*, 78*b*.

The upper, lefthand and righthand side painting mechanisms 66, 68, 70 have outer frames comprising casings 88*a* through 88*c* with a bottom plate 90 secured to the lower end thereof. Side plates 92*a*, 92*b* are vertically affixed to the opposite edges of the lower surface of the bottom plate 90. A support member 94 is fixed to the lower end of the side plate 92*a*, and a transport motor 96 is fixed to the lower end of the support member 94. The transport motor 96 has a rotatable shaft 98 supporting on its distal end a pinion 100 meshing with the rack 82 fixed to the rail bracket 72.

A roller assembly 102*a* having a plurality of rollers engaging the rail 78*a* is mounted on the upper end of the support member 94. The roller assembly 102*a* comprises a roller 104 held in rolling engagement with the upper surface of the rail 78*a*, a pair of rollers 108*a*, 108*b* supported on a plate 106 fixed to the roller assembly 102*a* and rollingly held against the opposite sides of the rail 78*a*, and a roller 110 held in rolling contact with the lower surface of the rail 78*a*. Another roller assembly 102*b* is mounted on the side plate 92*b* by a support member 112. The roller assembly 102*b* comprises a roller 116 rotatably supported on a shaft 114 and held in rolling engagement with the upper surface of the rail 78*b*, and a roller 118 held in rolling contact with the lower surface of the rail 78*b*.

Figure 5:
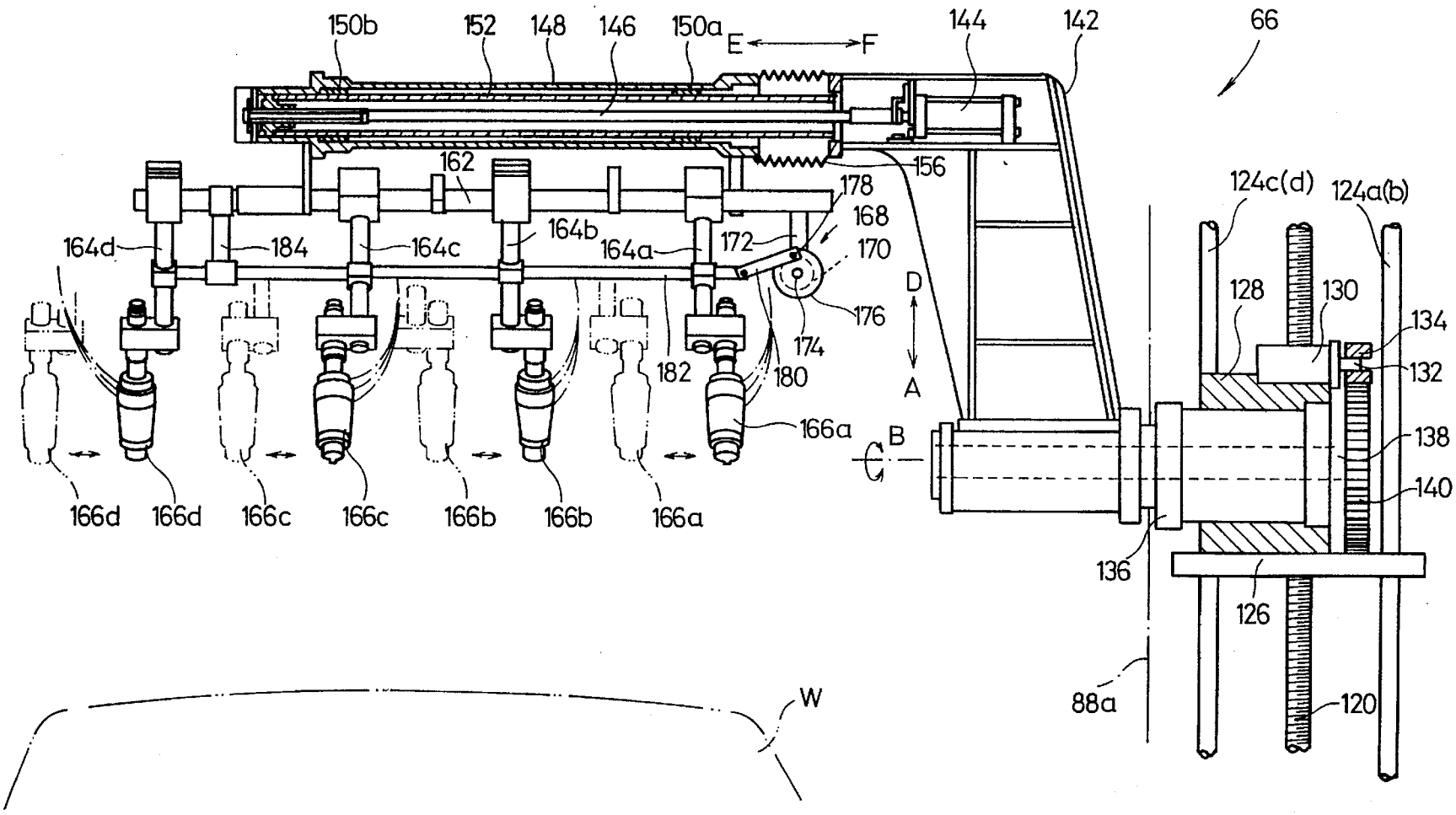
FIG. 5 is an elevational view, partly in cross section, of an upper painting mechanism of the painting apparatus shown in FIG. 2.

The upper painting mechanism 66 which is movable by the transport means described above will be described below. As shown in FIGS. 2 and 5, a vertical ball screw 120 is rotatably supported in the casing 88*a* and can be rotated about its own axis by a lifting/lowering motor 122 mounted on the upper surface of the casing 88*a*. Four guide rods 124*a* through 124*d* are disposed vertically parallel to each other around the ball screw 120. A horizontal support plate 126 is threadedly disposed around and held in mesh with the ball screw 120 and can be moved upwardly and downwardly by rotating the ball screw 120 about its own axis upon energization of the lifting/lowering motor 122.

As shown in FIG. 5, a turning motor 130 is fixed to the upper surface of the support plate 126 via a holder 128. The turning motor 130 has a rotatable shaft 132 on which a gear 134 is mounted. The holder 128 holds therein a bearing 136 supporting a turning shaft 138 having one end on which is mounted a gear 140 meshing with the gear 134. The other end of the turning shaft 138 projects out of the casing 88*a*, and one end of a swing arm 142 is secured to the projecting end of the turning shaft 138.

A shifting cylinder 144 is disposed as a shifting means on the other end of the swing arm 142. The shifting cylinder 144 has a piston rod 146 extending horizontally in transverse relation to the longitudinal direction of the vehicle body W or the rails 64*a*, 64*b*. A fixed shaft 148 having one end secured to the swing arm 142 is disposed loosely around the piston rod 146. A cylindrical slide sleeve 152 is slidably fitted over the fixed shaft 148 through slide bearings 150*a*, 150*b* interposed therebetween. The distal end of the piston rod 146 is fixed to the distal end of the slide sleeve 152. Between the other end of the slide sleeve 152 and the swing arm 142, there is mounted an expandable and contractable bellows-like cover member 156 for preventing paint deposits from being applied to the fixed shaft 148.

A horizontal gun arm 162 is coupled to the slide sleeve 152. Gun support bars 164*a* through 164*d* which are spaced from each other are swingably attached at ends thereof to the horizontal gun arm 162. Paint spray guns 166*a* through 166*d* are secured as paint spraying means respectively to the other ends of the gun support bars 164*a* through 164*d*. The paint spray guns 166*a* through 166*d* are swingable in unison by a swinging means 168.

The swinging means 168 includes a rotative drive source 170 suspended from a holder 172 coupled to one end of the horizontal gun arm 162. The rotative drive source 170 has a rotatable shaft 174 to which a disc 176 is secured. The disc 176 is operatively coupled to one end of a link 180 through an eccentric pin 178 spaced a distance from the center of rotation of the disc 176. The other end of the link 180 is coupled to a first short rod 182 which is fitted in and held by a support member 184 depending from the horizontal gun arm 162.

Figure 6:
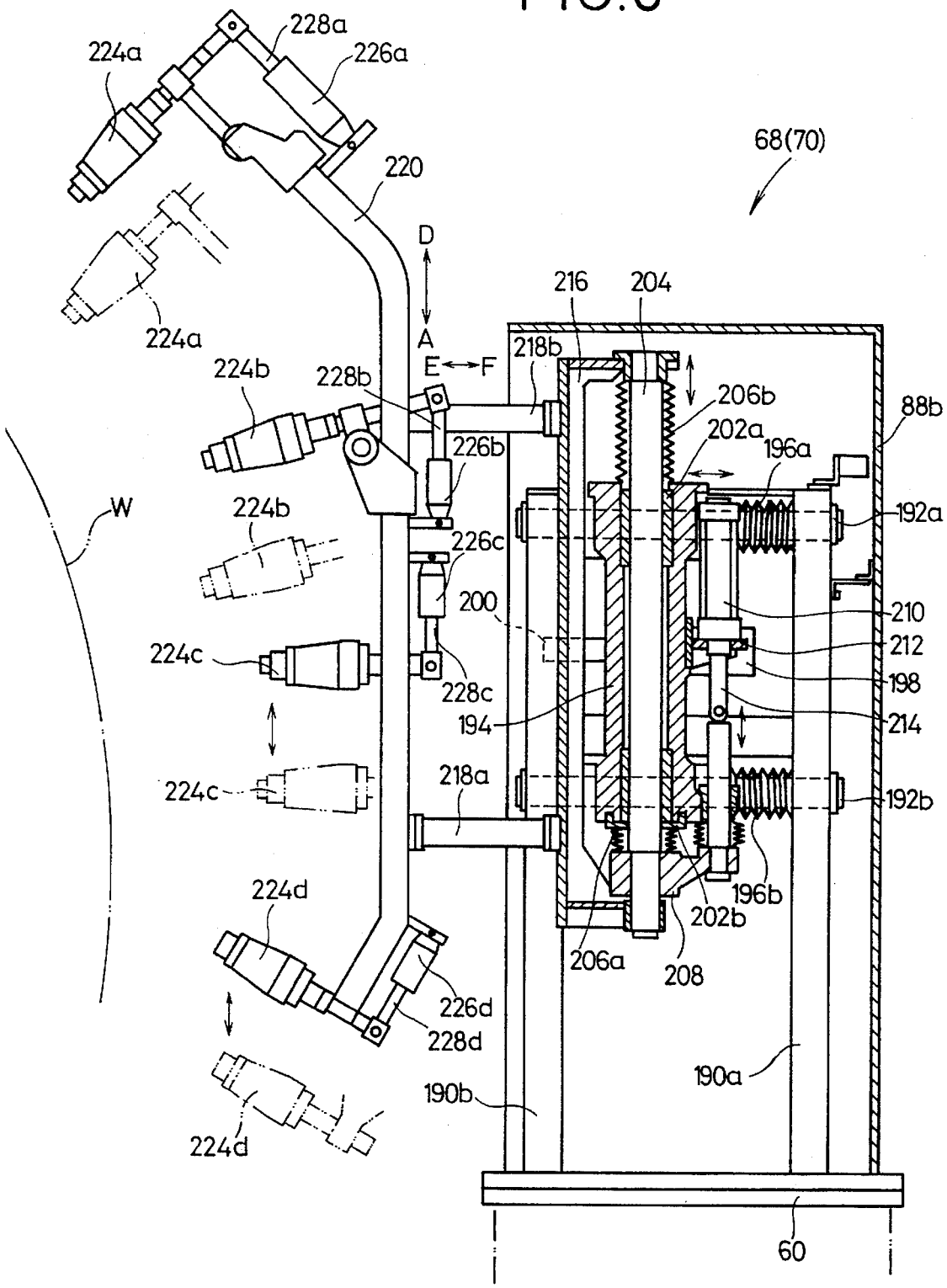
FIG. 6 is an elevational view, partly in cross section, of a side painting mechanism of the painting apparatus illustrated in FIG. 2.

The lefthand and righthand side painting mechanisms 68, 70 for coating the lefthand and righthand sides of the vehicle body W are shown in FIGS. 2 and 6. Since the lefthand and righthand side painting mechanisms 68, 70 are of basically the same construction, only the lefthand side painting mechanism 68 will be described, and the righthand side painting mechanism 70 will not be described with identical components denoted by identical reference numerals.

Vertical posts 190*a*, 190*b* are disposed in the casing 88*b* serving as the outer frame of the lefthand side painting mechanism 68. Two guide bars 192*a*, 192*b* extend horizontally between and are connected to the posts 190*a*, 190*b*, and a holder 194 is slidably mounted on the guide bars 192*a*, 192*b*. Expandable and contractable cover members 196*a*, 196*b* are disposed around the guide bars 192*a*, 192*b* between the holder 194 and the posts 190*a*, 190*b*. A horizontally moving cylinder 198 is fixed to the holder 194 and has a piston rod (not shown) with its distal end connected to the post 190*b* through a joint 200.

A shifting guide bar 204 extends vertically through and is slidably supported in the holder 194 by means of slide bearings 202*a*, 202*b*. Expandable and contractable cover members 206*a*, 206*b* are disposed around the upper and lower end portions of the shifting guide bar 204 which project from the holder 194. A joint 208 is attached to the lower end of the shifting guide bar 204. A shifting cylinder 210 is fixed as a shifting means to the outer periphery of the holder 194 through a bracket 212, and has a downwardly extending piston rod 214 coupled to the holder 194 through the joint 208.

A holder 216 is coupled to the shifting guide bar 204 at its upper and lower ends. A gun arm 220 is supported on the holder 216 through support members 218*a*, 218*b*. To the gun arm 220, there are attached paint spray guns 224*a* through 224*d* as paint spraying means which are spaced from each other. Cylinders 226*a* through 226*d* are swingably mounted on the gun arm 220 and have respective piston rods 228*a* through 228*d* coupled to the rear ends of the paint spray guns 224*a* through 224*d*, respectively.

The vehicle body W which has been coated in the third painting stage 12*c* thus constructed is then delivered into the fourth stage 12*d* in which the paint coating is dried.

The paint coating line and the painting apparatus according to the present invention are basically constructed as described above. A painting method which is carried out by the paint coating line and the painting apparatus will be described below.

In the first and second painting stages 12*a*, 12*b*, the inner panels, e.g., the inner surfaces of the engine compartment, the trunk compartment, and the doors of the vehicle body W which is kept at a rest are coated. More specifically, as shown in FIG. 1, the vehicle body W which has been transferred to the first stage 12*a* by the vehicle body conveyor mechanism 16 is stopped in a predetermined coating position. Then, an engine hood 230 is opened by the engine hood opening/closing mechanism 38, and a trunk lid 232 is opened by the trunk lid opening/closing mechanism 40. The engine compartment and the trunk compartment are then coated by the coating robots 36*a* through 36*d* which run along the rails 34*a*, 34*b*. Thereafter, the engine hood and the trunk lid are closed by the respective opening/closing mechanisms 38, 40, and then the vehicle body W is conveyed to the second painting stage 12*b* by the vehicle body conveyor mechanism 16.

In the second stage 12*b*, doors 234*a* through 234*d* of the vehicle body W are opened by the door opening/closing mechanisms 48*a*, 48*b*, and the inner surfaces of the doors 234*a* through 234*d* are coated by the coating robots 44*a*, 44*b* which travel along the rails 42*a*, 42*b*. The doors 234*a* through 234*d* are thereafter closed by the door opening/closing mechanisms 48*a*, 48*b*, and the vehicle body W is fed to the third painting stage 12*c* by the vehicle body conveyor mechanism 16.

In the third painting stage 12*c*, as shown in FIG. 2, the engaging member 60 of the vehicle body conveyor means 50 engages the finger 28 on the carriage 24 on which the vehicle body W is placed, and the engaging member 30 is released from the chain conveyor 32 to disconnect the carriage 24 from the chain conveyor 32, so that the vehicle body W can be moved back and forth by the vehicle body conveyor means 50. More specifically, the non-illustrated drive source in the casing 58 of the vehicle body conveyor means 50 is operated to displace the engaging member 60 from the solid-line position to the two-dot-and-dash-line position in FIG. 2. The finger 28 now engages in the recess 62 in the engaging member 60, whereupon the vehicle body W can be moved back and forth by the elongate cylinder 54 of the vehicle body conveyor means 50. At the same time, the upper painting mechanism 66, the lefthand side painting mechanism 68, and the righthand side painting mechanism 70 are positioned in front of the vehicle body W in a standby condition. On the upper painting mechanism 66, the lifting/lowering motor 122 is operated to rotate the ball screw 120 to lower the swing arm 142 from the position shown in FIG. 2 in the direction of the arrow A. The turning motor 130 is also energized to turn the swing arm 142 about the turning shaft 138 in the direction of the arrow B. The paint spray guns 166*a* through 166*d* mounted by the slide sleeve 152 on the end portion of the swing arm 142 are now oriented toward the front head of the vehicle body W, as shown in FIG. 3.

Figure 7:
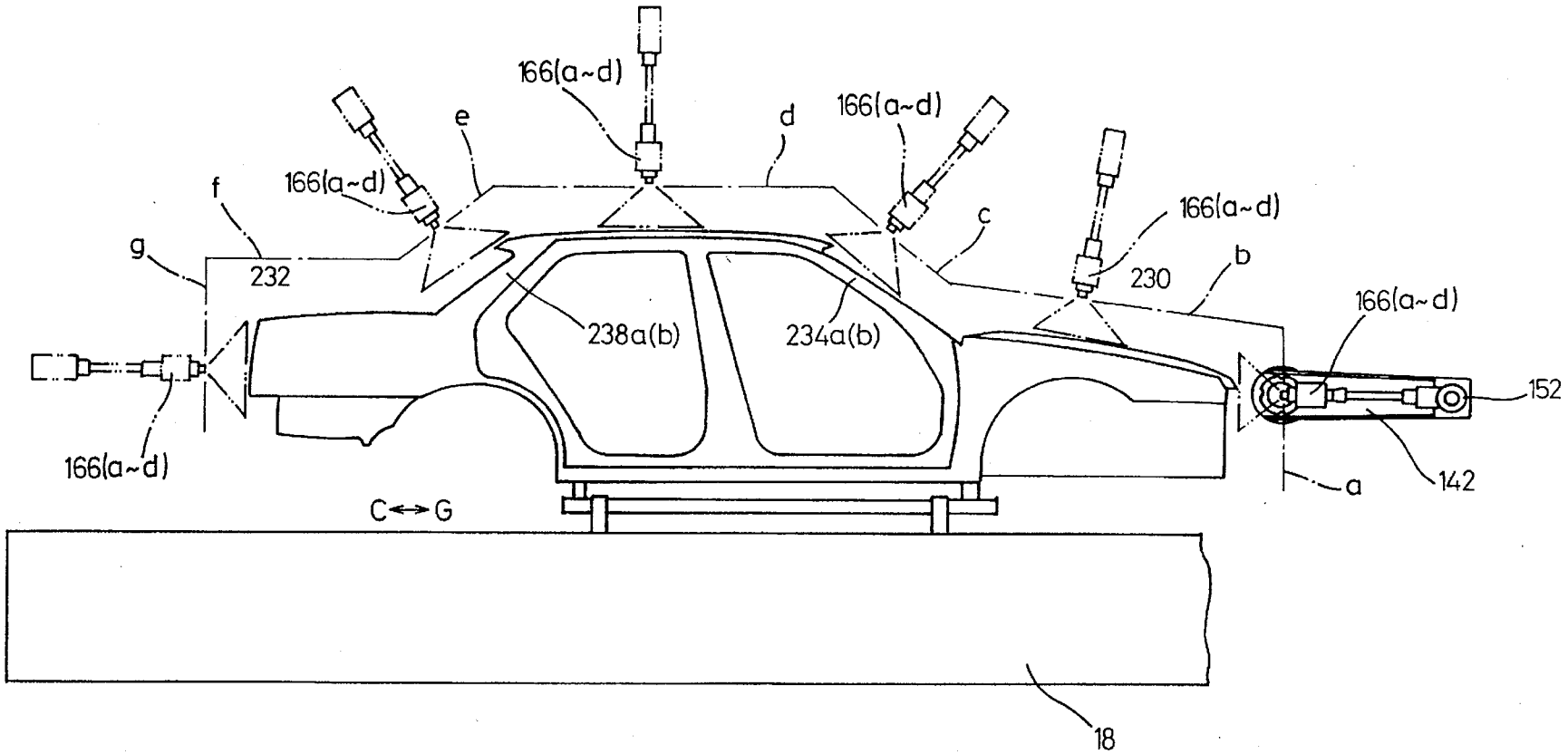
FIG. 7 is a side elevational view showing the manner in which an upper vehicle body portion is coated by the upper painting mechanism.

The upper painting mechanism 66 is moved toward the front end of the vehicle body W. More specifically, as shown in FIG. 4, the transport motor 94 is driven to rotate the pinion 70 meshing with the rack 82 to cause the upper painting mechanism 66 to start running along the rails 78*a*, 78*b*. The swing arm 142 is elevated in the direction of the arrow B in FIG. 2 by operating the lifting/lowering motor 122 to rotate the ball screw 120. While the swing arm 142 is being elevated, paint sprays are ejected from the paint spray guns 166*a* through 166*d* toward the front end of the vehicle body W. As shown in FIG. 7, the paint spray guns 166*a* through 166*d* move along a path a while coating the front end of the vehicle body W.

During this time, the vehicle body W is held at rest. The paint spray guns 166*a* through 166*d* are spaced at intervals so as to prevent the ejected paint sprays from interfering with each other. Therefore, the surface of the front end of the vehicle body W is coated with spaced strips of paint as shown in FIG. 3.

After the front end of the vehicle body W has been coated and when the paint spray guns 166*a* through 166*d* reach the boundary between the front end and the engine hood, the swing arm 142 is turned in the direction of the arrow B as illustrated in FIG. 5. More specifically, when the turning motor 130 is operated, the swing arm 142 is turned about the turning shaft 138 in the direction of the arrow B through the gear 140 meshing with the gear 134 supported on the shaft 132 of the turning motor 130. The paint spray guns 166*a* through 166*d* are now held perpendicularly to the engine hood 230 of the vehicle body W.

Then, the upper painting mechanism 66 is driven in the direction of the arrow C in FIGS. 3 and 7, while at the same time the vehicle body W is displaced in the opposite direction of the arrow G by by cylinder 54. The engine hood 230 is thus coated by the paint spray guns 166*a* through 166*d* which are moved along a path b due to such relative movement between the vehicle body W and the upper painting mechanism 66. The swing arm 142 is progressively elevated as the upper painting mechanism 66 is moved in the direction of the arrow C to keep the engine hood 230 and the paint spray guns 166*a* through 166*d* spaced a constant distance from each other while coating the engine hood 230.

Similarly, while the paint spray guns 166*a* through 166*d* are being spaced uniformly from the surface of the vehicle body W and directed perpendicularly to the vehicle body surface, front pillars 234*a*, 234*b*, a roof 236, rear pillars 238*a*, 238*b*, and a trunk lid 232 are coated as the paint spray guns 166*a* through 166*d* move along paths c, d, e, and f (FIG. 7). Finally, the swing arm 142 is turned to hold the paint spray guns 166*a* through 166*d* facing perpendicularly to the rear end of the vehicle body W. The paint spray guns 166*a* through 166*d* are displaced along a path g while coating the rear end of the vehicle body W. When coating the rear end of the vehicle body W, the vehicle body W is held at rest.

At the same time that the upper surfaces of the vehicle body W are coated by the upper painting mechanism 66, the lateral sides of the vehicle body W are coated by the lefthand and righthand side painting mechanisms 68, 70 as follows:

The lefthand and righthand side painting mechanisms 68, 70 are moved along the rails 64*a*, 64*b* in the direction of the arrow C while at the same time paint sprays are applied from the paint spray guns 224*a* through 224*d* to the lateral sides of the vehicle body W. The paint spray guns 224*a* through 224*d* are spaced from each other, so that spaced strips of paint are applied to the sides of the vehicle body W without mutual interference. While the lefthand and righthand side painting mechanisms 68, 70 are running, the paint spray guns 224*a* through 224*d* are displaced in the directions of the arrows E, F in FIG. 6 by the horizontally moving cylinder 198 so as to be kept a constant distance from the sides of the vehicle body W for uniformly coating the vehicle body sides.

The lefthand and righthand side painting mechanisms 68, 70 are moved while they are being spaced a given distance from the upper painting mechanism 66, and the vehicle body W is moved by the vehicle body conveyor means 50 in the direction opposite to the direction of movement of the painting apparatus 52. More specifically, as shown in FIG. 2, the paint spray gun 166*a* of the upper painting mechanism 66 and the paint spray gun 224*a* of the lefthand side painting mechanism 68 are spaced a distance from each other at all times, whereas the paint spray gun 166*d* of the upper painting mechanism 66 and the paint spray gun 224*a* of the righthand side painting mechanism 70 are spaced a distance from each other at all times. By moving the painting mechanisms 66, 68, 70 in the same direction and also moving the vehicle body W in the opposite direction to the painting mechanisms 66, 68, 70 while coating the vehicle body W, as described above, since the distance the vehicle body W has to travel in coating the entire vehicle body W is reduced, the third painting stage 12*c* only takes up a small space, and the outer surfaces of the vehicle body W can efficiently be coated.

The vehicle body W is thus coated with strips of paint as indicated by the shaded areas in FIG. 3.

Then, the paint spray guns 224*a* through 224*d* are shifted in a direction normal to the direction of travel of the vehicle body W for coating uncoated areas of the vehicle body W. More specifically, on the lefthand and righthand side painting mechanisms 68, 70, the shifting cylinder 210 is operated (FIG. 6). The rod 214 is lowered to cause the joint 208 to move the guide bar 204 downwardly in the direction of the arrow A. As a consequence, the paint spray guns 224*a* through 224*d* are shifted to the two-dot-and-dash-line position in FIG. 6 by the holder 216 supported on the guide bar 204.

Thereafter, the lefthand and righthand side painting mechanisms 68, 70 are moved in the direction of the arrow B along the lateral sides of the vehicle body W in the same manner as described above, and paint sprays are discharged from the paint spray guns 224*a* through 224*d* to coat the uncoated areas or strips.

On the upper painting mechanism 66, at the same time, the shifting cylinder 144 (FIG. 5) in the swing arm 142 is operated to extend the piston rod 146 in the direction of the arrow E. Since the end of the piston rod 146 is coupled to the slide sleeve 152, the side sleeve 152 is displaced therewith along the fixed shaft 148. Thus, the paint spray guns 166*a* through 166*d* coupled to the slide sleeve 152 by the horizontal gun arm 162 are shifted to the two-dot-and-dash-line position in FIG. 5.

Then, in FIG. 7, the upper painting mechanism 66 is moved along the rail 64*a* in the direction of the arrow G while coating the unpainted areas or strips on the vehicle body W with the paint spray guns 224*a* through 224*d* as they are displaced along the paths a through g. At this time, too, the lefthand and righthand side painting mechanisms 68, 70 and the upper painting mechanism 66, while they are running, are spaced from each other to avoid mutual interference of paint sprays discharged therefrom, and the vehicle body W is moved in the opposite direction to the painting mechanisms 66, 68, 70. Finally, the vehicle body W and the painting apparatus 52 return to the original position in the third stage 12*c*, so that they are readily available for a next coating cycle.

After the vehicle body W has fully been coated, it is disconnected from the vehicle body conveyor means 50 and delivered by the conveyor mechanism 16 into the fourth stage 12*d* where the vehicle body W is dried.

Figures 8A, 8B, 8C:
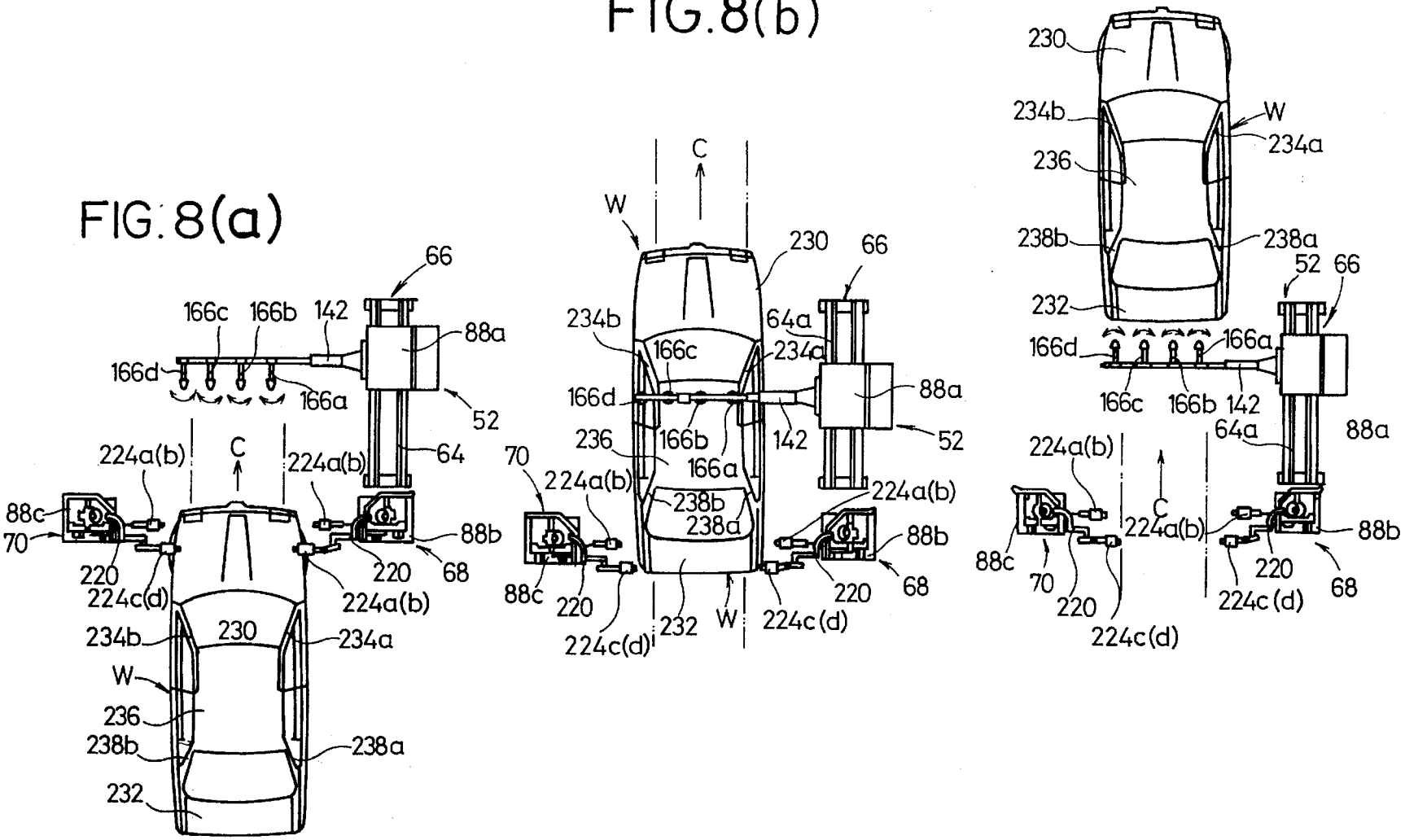
FIGS. 8(*a*), 8(*b*), and 8(*c*) are plan views showing a second painting method according to the present invention.

A second painting method according to the present invention will be described below with reference to FIGS. 2 and 8(*a*), 8(*b*), and 8(*c*), in connection with the painting process in the third painting stage 12*c*. The process of the second painting method is illustrated in FIGS. 8(*a*), 8(*b*), and 8(*c*).

When the vehicle body W is delivered to the third stage 12*c* by the conveyor mechanism 16, paint sprays are ejected from the paint spray guns 224*a* through 224*d* of the side painting mechanisms 68, 70 toward the lateral sides of the vehicle body W. Unlike the first painting method described above, the paint sprays are ejected while operating the cylinders 226*a* through 226*d* on the gun arm 220 to swing the paint spray guns 224*a* through 224*d*.

When the front end of the vehicle body W reaches a position spaced a predetermined distance from the paint spray guns 166*a* through 166*d* of the upper painting mechanism 66, paint spray guns start being applied from the paint spray guns 166*a* through 166*d* which are being angularly moved back and forth.

More specifically, as shown in FIG. 2, the rotative drive source 170 is energized to rotate the shaft 174, thus rotating the disc 176 coupled to the shaft 174. The first rod 182 is therefore displaced back and forth in the directions of the arrows E, F by the link 180 coupled to the pin 178 on the disc 176. Therefore, the gun support bars 164*a* through 164*d* which is swingably connected to the horizontal gun arm 162 are swung back and forth about their upper ends, thereby swinging the paint spray guns 166*a* through 166*d*.

The lifting/lowering motor 122 is driven to rotate the ball screw 120 for causing the support plate 126 to elevate the swing arm 142 in the direction of the arrow D. Thus, the paint spray guns 166*a* through 166*d* as they swing back and forth in the directions of the arrows E, F are moved upwardly along the front end configuration of the vehicle body W.

The transport motor 96 is driven to move the upper paint mechanism 66 along the rails 78*a*, 78*b* in the direction of the arrow C. The front end of the vehicle body W which is being conveyed in the direction of the arrow C by the conveyor mechanism 16 can be coated by the paint spray guns 166*a* through 166*d* which are spaced a prescribed distance from the front end of the vehicle body W.

After the vehicle body front end has been coated, the transport motor 96 is inactivated, or the speed of rotation thereof is reduced, and the turning motor 130 is operated. The swing arm 142 is now turned about the shaft 138 in the direction of the arrow B by the gear 140 meshing with the gear 134 on the shaft 132 of the turning motor 130. The paint spray guns 166*a* through 166*d* on the swing arm 142 are oriented perpendicularly to the engine hood 230 of the vehicle body W. While conveying the vehicle body W at a given speed in the direction of the arrow C with the conveyor mechanism 16, the engine hood 230 is coated by the paint spray guns 166*a* through 166*d*.

After completion of the coating of the engine hood 230, the lifting/lowering motor 122 is driven to elevate the swing arm 142 to keep the paint spray guns 166*a* through 166*d* spaced a given distance from the roof 236 of the vehicle body W, whereupon the lifting/lowering motor 122 is inactivated. Then, the paint spray guns 166*a* through 166*d* start coating the roof 236 of the vehicle body W, as shown in FIG. 8(*b*).

As shown in FIG. 8(*b*), the lateral sides of the vehicle body W have substantially completely been coated by the side painting mechanisms 68, 70 by this time. In coating the vehicle body sides, the gun arms 220 of the side painting mechanisms 68, 70 are displaced vertically (in the directions of the arrows A, D) and horizontally (in the directions of the arrows E, F) to move the paint spray guns 224*a* through 224*d* along the configurations of the vehicle body sides to apply uniform paint coating layers to the lateral sides of the vehicle body W.

When the coating of the roof 236 with the paint spray guns 166*a* through 166*d* is finished, the lifting/lowering motor 122 is operated to displace the swing arm 142 in the direction of the arrow A until the paint spray guns 166*a* through 166*d* are spaced a predetermined distance from the trunk lid 232. Then, the lifting/lowering motor 122 is inactivated. Thus, the trunk lid 232 of the vehicle body W as it is delivered in the direction of the arrow C is coated by the paint spray guns 166*a* through 166*d*.

The turning motor 130 is operated to turn the swing arm 142 to direct the paint spray guns 166*a* through 166*d* perpendicularly to the rear end of the vehicle body W, and the lifting/lowering motor 122 is driven to lower the swing arm 142. As shown in FIG. 8(*c*), the transport motor 96 is driven to move the upper painting mechanism 66 at a prescribed speed in the direction of the arrow C to keep the paint spray guns 166*a* through 166*d* spaced a constant distance from the rear end of the vehicle body W. Therefore, all the surfaces of the lateral sides, the engine hood 230, the roof 236, and the trunk lid 232 of the vehicle body W which is delivered in the direction of the arrow C by the conveyor mechanism 16 are fully coated.

According to the second coating method, it is possible to apply a uniform and sightly paint coating to the vehicle body W which is delivered at a prescribed speed by the conveyor mechanism 16, and also to increase the efficiency of the entire paint coating line by continuously delivering the vehicle body W being coated at a relatively high speed.

Specifically, as described above, when the front end of the vehicle body W and the paint spray guns 166*a* through 166*d* of the upper painting mechanism 66 become spaced a predetermined distance from each other, the paint spray guns 166*a* through 166*d* are angularly displaced back and forth by the swinging means 168, and also elevated by the lifting/ lowering motor 122. At this time, the upper painting mechanism 66 itself is moved at a prescribed speed in the direction of the arrow C in which the vehicle body W is delivered, by the transport motor 96. Accordingly, the front end of the vehicle body W can uniformly and effectively be coated while keeping the paint spray guns 166*a* through 166*d* spaced a given distance from the front end of the front end of the vehicle body W without stopping the delivery of the vehicle body W.

The engine hood 230, the roof 236, and the trunk lid 232 extend in the direction in which the vehicle body W is conveyed (as indicated by the arrow C). The engine hood 230, the roof 236, and the trunk lid 232 can be coated simply by directing the paint spray guns 166*a* through 166*d* vertically downwardly with the turning motor 130, lifting or lowering them with the lifting/lowering motor 122, and ejecting paint sprays from the paint spray guns 166*a* through 166*d*.

The rear end of the vehicle body W lies vertically as with the front end thereof. The transport motor 96 is operated to displace the upper painting mechanism 66 at a given speed in the same direction as that in which the vehicle body W is fed as indicated by the arrow C, so that the upper painting mechanism 66 can follow the vehicle body W. The rear end of the vehicle body W can therefore be coated by the paint spray guns 166*a* through 166*d* while maintaining the paint spray guns 166*a* through 166*d* spaced from the rear end of the vehicle body W at a predetermined distance.

As described above, when coating those surfaces which lie vertically, such as the front and rear ends of the vehicle body W, the vehicle body W is not stopped, but the paint spray guns 166*a* through 166*d* are moved while following the vehicle body W during the coating operation. Therefore, the vehicle body W can continuously be conveyed by the conveyor mechanism 16, so that the vehicle body W can quickly be coated. Even if the vehicle body W is delivered at a relatively high speed, no coating irregularities or failures are caused, but the vehicle body W can well be coated, and the entire paint coating line is rendered highly efficient.

The paint spray guns 166*a* through 166*d* are swingable in the direction normal to the direction of travel of the vehicle body W (as indicated by the arrow C) by the swinging means 268. Consequently, the engine hood 230, the roof 236, and the trunk lid 232 of the vehicle body W can uniformly and highly accurately be coated over their entire surfaces.

Figure 9:
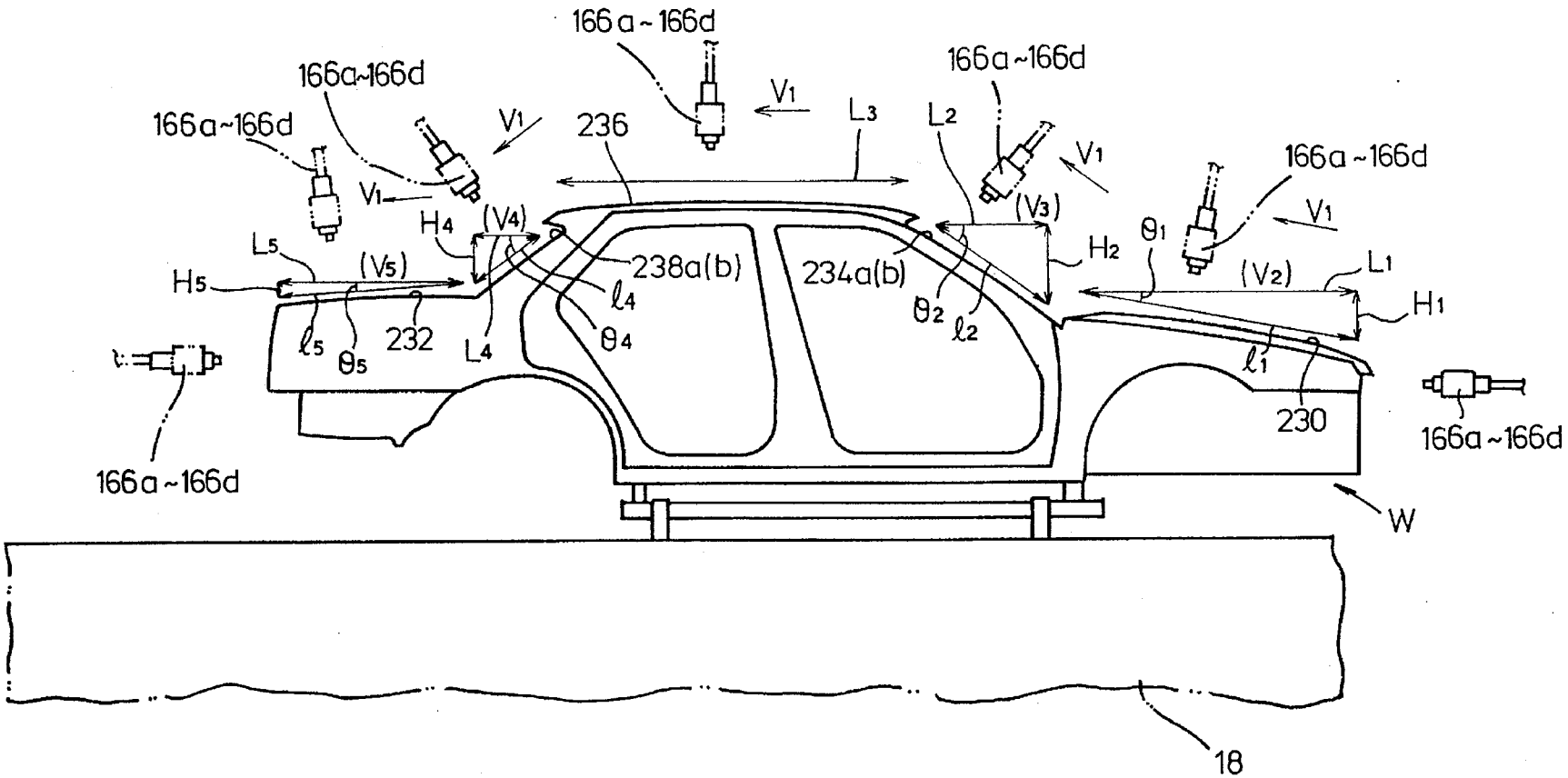
FIG. 9 is a side elevational view illustrating a third painting method according to the present invention.

A third painting method according to the present invention will be described below in connection with the painting process in the third painting stage 12*c*. The process of the third painting method is illustrated in FIG. 9.

When the vehicle body W is conveyed to the third stage 12*c* by the conveyor mechanism 16, paint sprays are ejected from the paint spray guns 224*a* through 224*d* of the side painting mechanisms 68, 70 to the lateral sides of the vehicle body W as shown in FIG. 8(*a*).

At the time the front end of the vehicle body W becomes spaced a predetermined distance from the paint spray guns 166*a* through 166*d* of the upper painting mechanism 66, paint sprays start to be discharged from the paint spray guns 166*a* through 166*d* toward the front end, and the paint spray guns 166*a* through 166*d* are swung back and forth.

The swing arm 142 is elevated to lift the paint spray guns 166*a* through 166*d* which are mounted on the swing arm 142 and are swung back and forth in the directions of the arrows E, F, along the shape of the front end of the vehicle body W.

At this time, the upper painting mechanism 66 is caused to run at a given speed in the direction of the arrow C. The front end of the vehicle body W which is delivered in the direction of the arrow C by the conveyor mechanism 16 is coated by the paint spray guns 166*a* through 166*d* that are spaced a distance from the front end of the vehicle body W.

Upon completion of the coating of the front end, the speed of travel of the upper painting mechanism 66 is reduced, and the swing arm 142 is turned to direct the paint spray guns 166*a* through 166*d* perpendicularly to the engine hood 230 of the vehicle body W while being spaced a predetermined distance therefrom. The engine hood 230 of the vehicle body W which is delivered at a prescribed speed in the direction of the arrow C by the conveyor mechanism 16 is now coated by the paint spray guns 166*a* through 166*d*.

The engine hood 230 is inclined at an angle of $\theta_1$ to the horizontal direction. To keep the paint spray guns 166*a* through 166*d* spaced a constant distance from the engine hood 230, the lifting/lowering motor 122 is driven to elevate the paint spray guns 166*a* through 166*d* by a height of $H_1$, and at the same time the transport motor 96 is operated to displace the upper painting mechanism 66 by a distance of $L_1$ at a relative speed described below. The paint spray guns 166*a* through 166*d* actually follow a path $l_1$ at this time. Assuming that the coating speed of the paint spray guns 166*a* through 166*d* which move along the path $l_1$ is $V_1$, then the relative speed $V_2$ between the upper painting mechanism 66 and the vehicle body W while coating the engine hood 230 is equal to $V_1\cos\theta_1$. The relative speed $V_2$ is directed in the opposite direction to the direction of the arrow C. Therefore, the actual relative speed $V_2$ between the upper painting mechanism 66 and the vehicle body W is determined from the desired coating speed $V_1$, and the upper painting mechanism 66 is moved at the determined relative speed $V_2$ with respect to the vehicle body W.

After the coating of the engine hood 230 is finished, the turning motor 130 is driven to turn the swing arm 142 in the direction of the arrow B. The paint spray guns 166*a* through 166*d* are now oriented perpendicularly to the front pillars 234*a*, 234*b* while being spaced a predetermined distance from the front pillars 234*a*, 234*b*. The relative speed of the paint spray guns 166*a* through 166*d* and the vehicle body W is varied in the following manner, while the front pillars 234*a*, 234*b* are being coated by the paint spray guns 166*a*, 166*d*. At this time, the paint spray guns 166*b*, 166*c* are disabled. The front pillars 234*a*, 234*b* are inclined at an angle of $\theta_2$ to the horizontal direction. To keep the paint spray guns 166*a* through 166*d* spaced a constant distance from the front pillars 234*a*, 234*b*, the lifting/lowering motor 122 is driven to elevate the paint spray guns 166*a* through 166*d* by a height of $H_2$, and at the same time the transport motor 96 is operated to displace the upper painting mechanism 66 by a distance of $L_2$ at a relative speed lower than the relative speed employed when the engine hood 230 is coated. The paint spray guns 166*a* through 166*d* actually follow a path $l_2$ at this time. The coating speed of the paint spray guns 166*a* through 166*d* which move along the path $l_2$ is adjusted to $V_1$. Then, the upper painting mechanism 66 is moved at a relative speed of $V_3$ which is expressed by $V_3=V_1\cos\theta_2$.

Upon completing the coating of the front pillars 234*a*, 234*b*, the turning motor 130 is driven to direct the paint spray guns 166*a* through 166*d* vertically downwardly, and then the turning motor 130 is inactivated. The paint spray guns 166*a* through 166*d* are vertically oriented and spaced a prescribed distance from the roof 236. Since the roof 236 lies horizontally, the transport motor 96 is driven to move the upper painting mechanism 66 with respect to the vehicle body W at a relative speed which is the same as the coating speed $V_1$. As a result, the paint spray guns 166*a* through 166*d* are displaced a distance of $L_3$ at the relative speed equal to the coating speed $V_1$ while coating the roof 236.

As can be seen from FIG. 8(*b*), the coating of the lateral sides of the vehicle body W with the side painting mechanisms 68, 70 is substantially completed at this time. In coating the lateral sides of the vehicle body W, the turn arms 220 of the side painting mechanisms 68, 70 are displaced vertically (in the directions of the arrows A, D) and horizontally (in the directions of the arrows E, F) to move the paint spray guns 224*a* through 224*d* along the configurations of the vehicle body sides to apply uniform paint coating layers to the lateral sides of the vehicle body W.

When the coating of the roof 236 is finished, the turning motor 130 is driven to turn the swing arm 142 in the direction of the arrow B until the paint spray guns 166*a* through 166*d* are directed perpendicularly to the rear pillars 238*a*, 238*b* while being spaced a predetermined distance therefrom. Then, the paint spray guns 166*b*, 166*c* are disabled, and the paint spray guns 166*a*, 166*d* are operated to coat the rear pillars 238*a*, 238*b*. The rear pillars 238*a*, 238*b* are inclined at an angle of $\theta_4$ to the horizontal direction. To keep the paint spray guns 166*a* through 166*d* spaced a constant distance from the rear pillars 238*a*, 238*b*, the lifting/lowering motor 122 is driven to elevate the paint spray guns 166*a* through 166*d* by a height of $H_4$, and at the same time the transport motor 96 is operated to displace the upper painting mechanism 66 by a distance of $L_4$ at a relative speed described below. The paint spray guns 166*a* through 166*d* actually follow a path $l_4$ at this time. The upper painting mechanism 66 is moved at a relative speed of $V_4=V_1\cos\theta_4$ with respect to the vehicle body W, so that the paint spray guns 166*a* through 166*d* move at the coating speed $V_1$ along the path $l_4$.

After completion of the coating of the rear pillars 238*a*, 238*b* with the paint spray guns 166*a*, 166*d*, the turning motor 130 is driven to turn the swing arm 142 in the direction of the arrow B. The paint spray guns 166*a* through 166*d* are now spaced a given distance from and directed perpendicularly to the trunk lid 232. The paint spray guns 166*a* through 166*d* are operated to coat the trunk lid 232. The trunk lid 232 is inclined at an angle of $\theta_5$ to the horizontal direction. To keep the paint spray guns 166*a* through 166*d* spaced a constant distance from the trunk lid 232, the lifting/lowering motor 122 is driven to lower the paint spray guns 166*a* through 166*d* by a height of $H_5$, and at the same time the transport motor 96 is operated to displace the upper painting mechanism 66 by a distance of $L_5$ at a relative speed described below. The paint spray guns 166*a* through 166*d* actually follow a path $l_5$ at this time. The upper painting mechanism 66 is moved at a relative speed of $V_5=V_1\cos\theta_5$ with respect to the vehicle body W, so that the paint spray guns 166*a* through 166*d* move at the coating speed $V_1$ along the path $l_5$.

Then, the turning motor 130 is driven to turn the swing arm 142 in the direction of the arrow B to reorient the paint spray guns 166*a* through 166*d* perpendicularly to the rear end of the vehicle body W, and the lifting/lowering motor 122 is operated to lower the swing arm 142. At this time, as illustrated in FIG. 8(*c*), the transport motor 96 is operated to move the upper painting mechanism 66 at a predetermined speed in the direction of the arrow C to keep the paint spray guns 166*a* through 166*d* and the rear end of the vehicle body W spaced a constant distance from each other. The lateral sides, the engine hood 230, the front pillars 234*a*, 234*b*, the roof 236, the rear pillars 238*a*, 238*b*, and the trunk lid 232 of the vehicle body W as it is delivered in the direction of the arrow C by the conveyor mechanism 16 are now all coated.

According to the third painting method, the paint spray guns 166*a* through 166*d* are directed perpendicularly to and spaced a predetermined distance from the engine hood 230, the front pillars 234*a*, 234*b*, the roof 236, the rear pillars 238*a*, 238*b*, and the trunk lid 232 of the vehicle body W which is being conveyed at a prescribed speed in the direction of the arrow C by the conveyor mechanism 16. The transport motor 96 is driven to vary the relative speed of the upper painting mechanism 66 with respect to the vehicle body W dependent on the surfaces of the vehicle body W that are to be coated. The vehicle body surfaces are coated while the coating speed of the paint spray guns 166*a* through 166*d* with respect to these surfaces is being kept at a constant level. Therefore, the paint coating layers on the respective surfaces of the vehicle body W are maintained at a constant level. Even if some of the surfaces to be coated are inclined with respect to the horizontal direction, the entire surfaces of the vehicle body W can be coated accurately with paint coating layers of a uniform thickness.

With the first painting method of the present invention, for coating the inner and outer surfaces of an object, the object is first conveyed to a predetermined position and stopped, and the inner surfaces are coated. Then, the object is further conveyed to another given position and stopped, after which the object is delivered at a relatively low speed by the conveyor means. While the object is being thus delivered in one direction, the painting apparatus for coating the outer surfaces of the object are moved in a direction opposite to the direction of travel of the object, during which time the outer surfaces of the object are coated by the painting apparatus. Therefore, the efficiency of coating of the object is increased, and the overall paint coating line takes up a reduced space.

With the second painting method and painting apparatus of the invention, for coating an automobile vehicle body which is delivered at a prescribed speed by the conveyor mechanism, the upper paint spray guns are displaced back and forth along the direction of travel of the vehicle body in applying paint coatings to the front, upper, and rear surfaces of the vehicle body. When coating the front and rear ends of the vehicle body in the direction of travel thereof, in particular, the upper paint spray guns are displaced in the direction of travel of the vehicle body and apply paint coatings to the front and rear ends while maintaining the paint spray guns spaced a constant distance from the front and rear ends of the vehicle body. Consequently, the vehicle body can efficiently be coated in one operation without stopping the delivery of the vehicle body. This coating process is effective in coating the vehicle body when it is conveyed at a high speed. The upper spray guns are vertically movable and angularly movable, and also swingable in a direction normal to the direction in which the vehicle body is conveyed. Therefore, it is possible to apply a unifrom and sightly paint coating layer to the entire surfaces of the vehicle body.

With the third painting method of the invention, the paint spraying means is spaced a prescribed distance from the surfaces to be coated of an automotive vehicle body which is delivered at a predetermined speed, and also is directed substantially perpendicularly to the vehicle body surfaces. The paint spray means is moved at a coating speed which remains constant at all times with respect to any of the surfaces of the vehicle body which are to be coated, while a paint coating is being applied to the vehicle body surfaces by the paint spray means. Therefore, a horizontal surface such as a roof and inclined surfaces such as front pillars and rear pillars can be coated under the same coating conditions.

As a result, the overall surfaces of the vehicle body can be coated with a highly accurate and uniform paint coating layer without coating irregularities or defects in a highly efficient manner.

Although certain preferred embodiments have been shown and described, it should be understood that many changes and modifications may be made therein without departing from the scope of the appended claims.

What is claimed is:

1. A method of painting a front end, engine hood, front pillars, a roof, rear pillars, a trunk lid and a rear end of a vehicle body having a longitudinal axis comprising the steps of:

moving said vehicle body by a conveyor mechanism in a direction of the longitudinal axis;

directing paint spraying means substantially perpendicularly to surfaces to be coated of said vehicle body which is being conveyed, said surfaces having different angles of inclination;

spacing said paint spraying means from said surfaces of the vehicle body;

controlling the velocity of movement of said paint spraying means to vary horizontal and vertical components of velocity of the paint spraying means dependent on said different angles of inclination of said surface such that said surfaces will be coated at a constant relative velocity by said paint spraying means, the direction of movement of the paint spraying means being generally along the longitudinal axis of the vehicle body, the controlling including adjusting height of the paint spraying means; and ejecting paint sprays from said paint spraying means to form paint coatings on said surfaces of the vehicle body while the vehicle body and the paint spraying means both continue to be moved.

2. The method according to claim 1, further comprising the step of providing an arm on the paint spraying means, said arm having a longitudinal axis which is generally perpendicular to the longitudinal axis of the object as the object is being conveyed.

3. The method according to claim 2, further comprising the step of pivoting the arm about the longitudinal axis thereof in order to maintain the paint sprays from the paint spraying means generally perpendicular to the surfaces of the object to be coated.

4. The method according to claim 1, further comprising the step of moving the paint spraying means horizontally relative to a fixed position, the paint spraying means being moved in a direction in which the object is conveyed, the direction being generally parallel to the longitudinal axis of the object.

5. The method according to claim 1, wherein the paint spraying means travels with respect to an inclined surface of the object to be coated at a velocity $V_1$, and said horizontal and vertical components of said velocity $V_1$ are determined utilizing the formulae:

$$V_h=V_1\cos\theta, V_v=V_1\sin\theta$$

wherein $V_h$ is the horizontal component of velocity of the paint spraying means, $V_v$ is the vertical component of velocity of the paint spraying means, and $\theta$ is the angle of inclination of the surface, wherein said horizontal and vertical components of velocity are used in the controlling step for adjusting a relative velocity of movement of said paint spraying means.

* * * * *